US006331055B1

(12) United States Patent
Miller et al.

(10) Patent No.: US 6,331,055 B1
(45) Date of Patent: Dec. 18, 2001

(54) INKJET PRINTHEAD WITH TOP PLATE BUBBLE MANAGEMENT

(75) Inventors: Michael D. Miller, Shedd; Garrard Hume, Corvallis, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/386,032

(22) Filed: Aug. 30, 1999

(51) Int. Cl.[7] ..... B41J 2/19
(52) U.S. Cl. ..... 347/92
(58) Field of Search ..... 347/92, 20, 40, 347/47, 63, 65, 89, 58, 85–87

(56) References Cited

U.S. PATENT DOCUMENTS 4,528,577 7/1985 Cloutier et al. .
4,578,687 3/1986 Cloutier et al. .
5,198,834 3/1993 Childers et al. .
5,291,226 3/1994 Schantz et al. .
5,595,785 1/1997 Hindagolla et al. ..... 427/271
6,017,117 * 1/2000 McClelland et al. ..... 347/89
6,056,391 * 5/2000 Kasamoto et al. ..... 347/58

* cited by examiner

*Primary Examiner*—Judy Nguyen

(57) ABSTRACT

An ink jet printhead is provided with an orifice plate connected to the barrier layer, spaced apart from the substrate second major surface, enclosing the ink manifold, and defining a plurality of orifice apertures, each associated with a respective ink energizing element, wherein the orifice plate has a planar plate defining the plurality of orifice apertures and at least one groove. The at least one groove extends from an ink feed slot region of the inkjet printhead to a bubble collection area adjacent to an end firing chamber located beyond the ink feed slot region to facilitate guiding bubbles away from critical areas.

29 Claims, 6 Drawing Sheets

INKJET PRINTHEAD WITH TOP PLATE BUBBLE MANAGEMENT

FIELD OF THE INVENTION

This invention relates to inkjet printers, and more particularly to inkjet printers with thermal inkjet printheads.

BACKGROUND OF THE INVENTION

Inkjet printers employ pens having printheads that reciprocate over a media sheet and expel droplets onto the sheet to generate a printed image or pattern. A typical printhead includes a silicon chip substrate having a central ink hole that communicates with an ink filled chamber of the pen when the rear of the substrate is mounted against the pen. An array of firing resistors is positioned on the front of the substrate, within a chamber enclosed peripherally by a barrier layer surrounding the resistors and the ink aperture. An orifice plate connected to the barrier just above the front surface of the substrate encloses the chamber, and defines a firing orifice just above each resistor. Additional description of basic printhead structure may be found in "The Second-Generation Thermal Inkjet Structure" by Ronald Askeland et al. in the Hewlett-Packard Journal, August 1988, pages 28–31; "Development of a High-Resolution Thermal Inkjet Printhead" by William A. Buskirk et al. in the Hewlett-Packard Journal, October 1988, pages 55–61; and "The Third-Generation HP Thermal Inkjet Printhead" by J. Stephen Aden et al. in the Hewlett-Packard Journal, February 1994, pages 41–45, which are hereby incorporated by reference.

For a single color pen, the resistors are arranged in two parallel elongated arrays that each extend nearly the length of the substrate to provide a maximum array length for a given substrate chip size. The resistor arrays flank opposite sides of the ink aperture, which is typically an elongated slot or elongated array of holes. To ensure structural integrity of the substrate, the ink aperture does not extend too close to the substrate edges, or as close to the edges as the endmost several firing resistors. Therefore, several resistors at each end of each array extend beyond the end of the ink supply aperture or slot.

While a reasonably effective configuration, it has been found that the end firing elements, that is, those that include the end resistors, are more susceptible to failure than are the multitude of firing elements that adjoin the length of the ink supply slot. It is believed that small air bubbles come primarily from two sources: those that arise from outgassing of ink components during normal operation, and those left behind after completion of pen assembly. These bubbles tend to aggregate and coalesce into larger bubbles in ends of the ink chamber. This occurs in the portions beyond the ends of the ink supply slots, and in the vicinity of the end resistors. Small bubbles present are normally tolerated because they can usually be "ejected," with only a single ink droplet being omitted from printed output; the firing element then continues properly following the momentary tolerable failure. However, it is believed that when the small tolerable bubbles are permitted to coalesce, they become large enough to permanently block one or more firing elements, preventing ink from reaching a firing resistor.

Thus, there is a need for an inkjet printhead that provides bubble management for facilitating moving bubbles away from the firing element region and promoting migration and coalescence of small bubbles away from the inkjet apertures.

SUMMARY OF THE INVENTION

Since bubbles tend to grow and expand into less constraining regions, the present invention provides grooves or depressions in a top plate that extend from the bubble collection area near the firing chambers toward the slot region. The present invention overcomes the limitations of the prior art by providing an inkjet printhead with an orifice plate connected to the barrier layer, spaced apart from the substrate second major surface, enclosing the ink manifold, and defining a plurality of orifice apertures, each associated with a respective ink energizing element, such that the orifice plate has a planar plate defining the plurality of orifice apertures and a plurality of grooves. At least two grooves each extend from an ink feed slot region of the inkjet printhead to a bubble collection area adjacent to an end firing chamber located beyond the ink feed slot region. The grooves collect bubbles and guide the bubbles away from critical areas, thus avoiding formation of larger bubbles that may permanently block ink from reaching one or more firing elements.

DETAILED DESCRIPTION OF PREFERRED EMBODIMENTS

Figure 1:
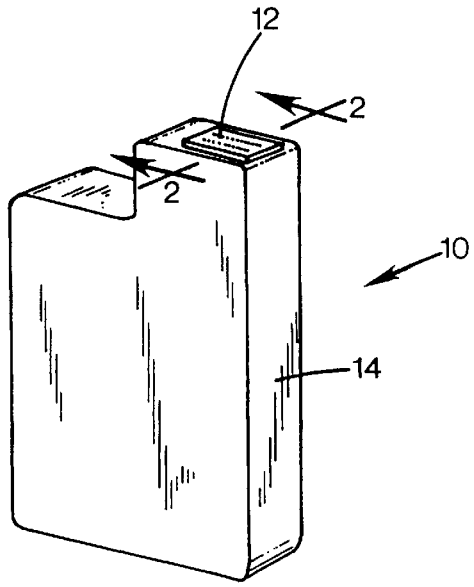
FIG. 1 is a perspective view of an inkjet pen according to a preferred embodiment of the invention.

FIG. 1 shows an inkjet pen 10 having a printhead 12. The pen has a pen body 14 defining a chamber or reservoir 24 (shown in FIG. 2) containing a supply of ink, which is supplied to the printhead 12. An electrical interconnect (not shown) provides connection between a printer in which the pen 10 is installed and the printhead 12, so that the printer may control printing in the printhead 12.

A plurality of ink energizing elements are located on the surface of the substrate away from the ink aperture. A barrier layer, which peripherally encloses an ink manifold, isolates and encompasses the ink aperture. An orifice plate is connected onto to the top of the barrier layer, which lies over the substrate and around the ink apertures. The orifice plate or top plate, defines a number of small orifices, each associated with a respective ink-energizing element. The ink manifold is preferably an elongated chamber having opposed ends defined by end wall portions of the barrier layer. The barrier end wall portions each have an intermediate end wall portion protruding into the manifold.

As bubbles tend to form in the printhead in the region between the top plate and the substrate, they coalesce and naturally tend to seek a larger volume into which they can continue to grow. The present invention provides grooves in the top plate that extend from an ink feed slot region of the inkjet printhead to a bubble collection area adjacent to an end firing chamber located beyond the ink feed slot region and also provides grooves in the top plate along edges of the ink feed slot region. The grooves collect bubbles and guide the bubbles away from critical areas, thus avoiding formation of large bubbles that may permanently block ink from reaching one or more firing elements.

Figure 2:
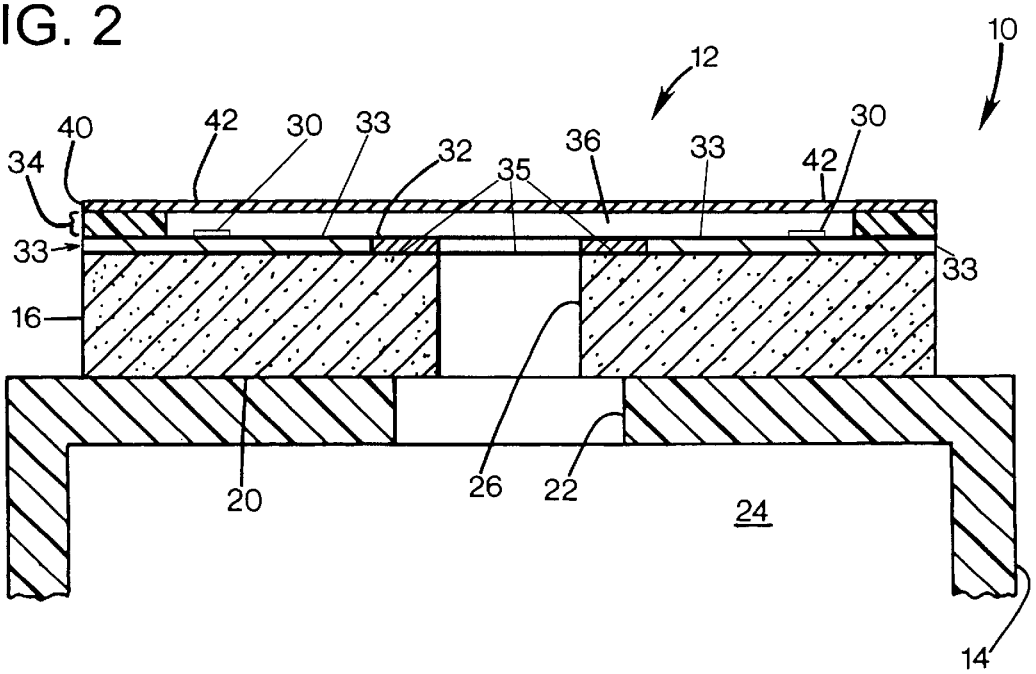
FIG. 2 is an enlarged sectional view of a printhead taken along line 2—2 of FIG. 1.

FIG. 2 shows the printhead 12 in cross section. The printhead 12 includes a silicon substrate 16 having a rear surface 20 mounted to the pen body 14. An ink outlet 22 in the pen body 14 opens into the ink chamber 24. The substrate 16 defines an ink channel or ink aperture 26 registered with the ink outlet 22. A number of firing resistors 30 are located on a first or upper surface 32 of the substrate, arranged in rows (not shown in FIG. 2) on opposite sides of the ink channel 26. Not readily shown in FIG. 2 are various thin film layers 33 of material that are deposited atop the first or upper substrate 16 surface and in which the firing resistors are typically formed. The thinfilm substrate includes various layers of insulating, conductive and resistive material. A material 33 is used to selectively deliver electrical energy to the firing resistors 30, which in turn heat up to deliver thermal energy into localized firing regions by which ink is boiled to cause it to be ejected onto a printing surface.

A barrier layer 34 is attached to the upper surface of the thin film layers 33, which are themselves atop the substrate 16, and covers the periphery of the substrate to laterally enclose an ink manifold chamber 36 and encompassing the resistors 30 and is patterned to form the firing chambers around those resistors. An orifice plate 40 is attached atop the barrier layer 34 to enclose the manifold chamber 36. The orifice plate 40 defines arrays of ink orifices 42, each of which is registered with a respective firing resistor 30. In the preferred embodiment, the orifice plate is approximately 25 microns thick, and the barrier layer is approximately 10–20 microns thick, typically 14 microns, although alternatives may be used, and the drawings are not to scale.

Figure 3:
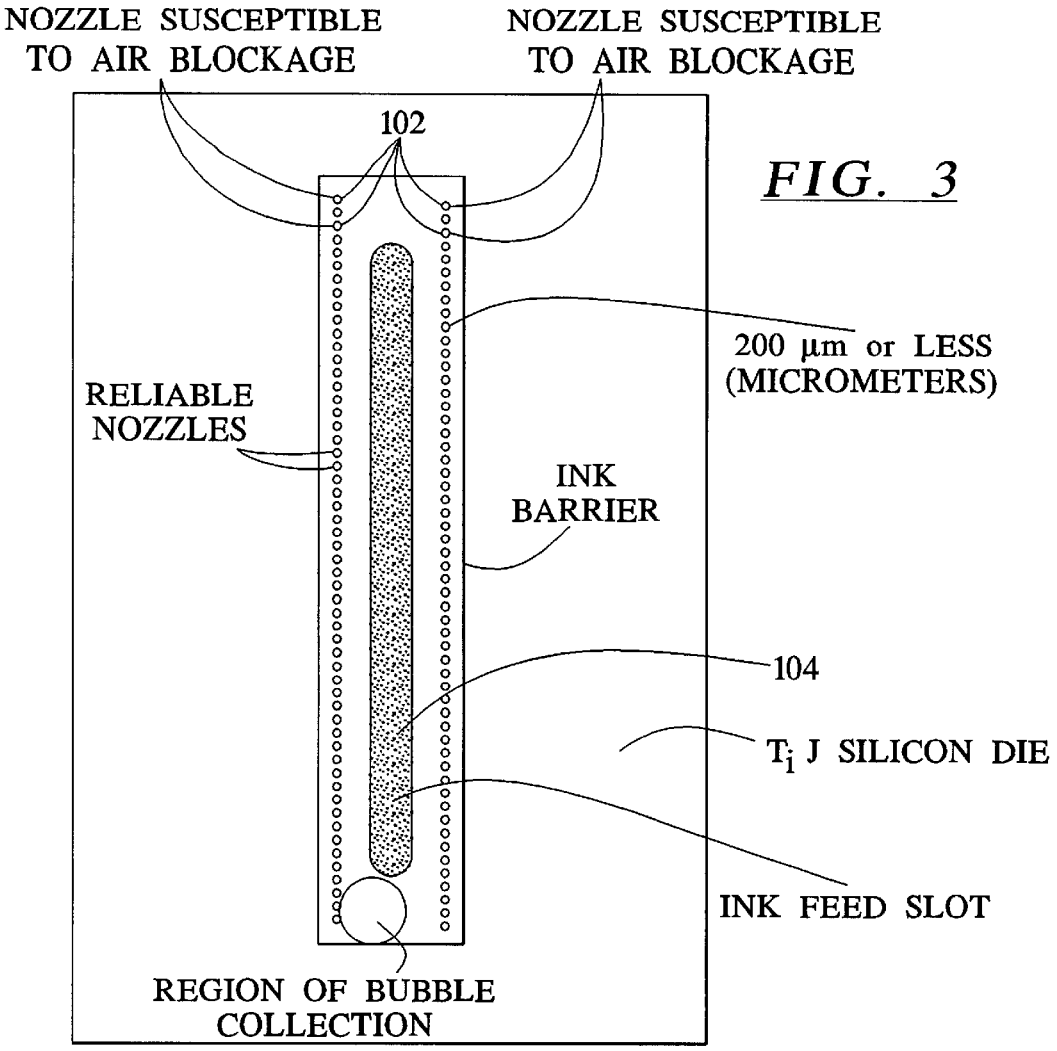
FIG. 3 shows a top view of the printhead with the top plate removed.

FIG. 3 shows a top view of the printhead with the top plate removed and with nozzles 102 susceptible to air blocking (by bubbles). The ink feed slot 104 is not extended because to do so would make the substrate more subject to breakage, i.e., the substrate width at the end of the slot would be so small that the likelihood of breakage would increase. In FIG. 3, the firing chambers in the barrier are not shown.

Figure 4:
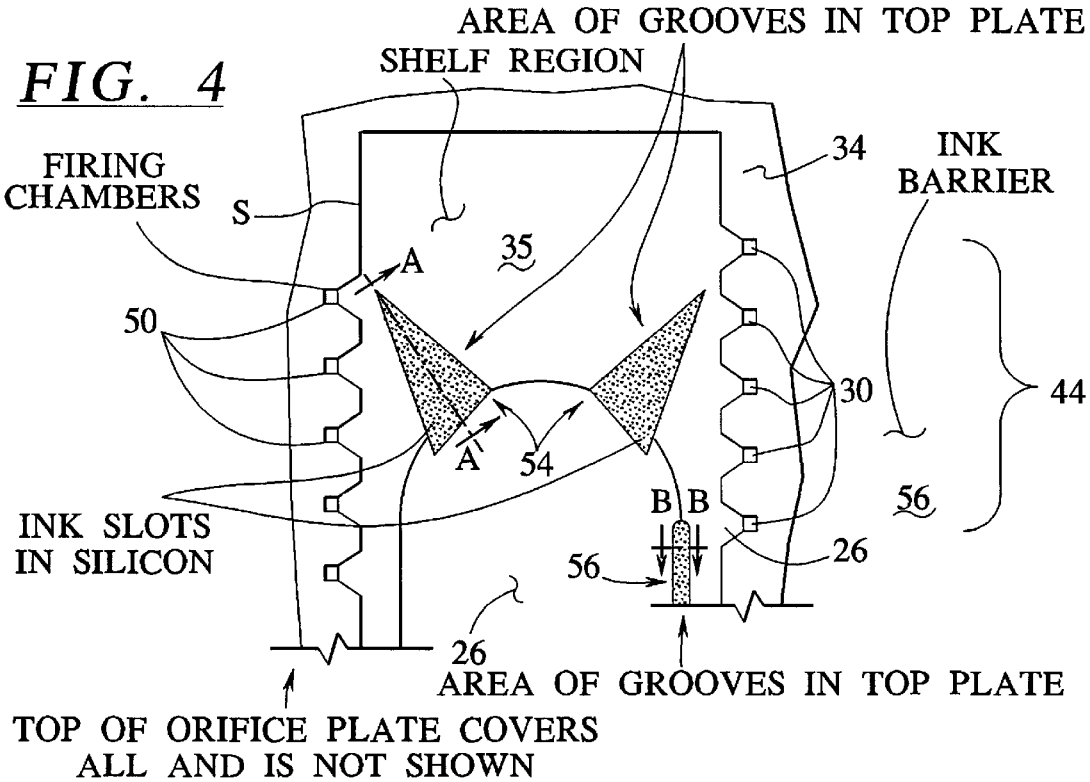
FIG. 4 shows a top view of one end of the shelf region at end of a slot in accordance with one embodiment of the present invention.

FIG. 4 shows a top view of one end of the shelf region at the end of a slot, for the printhead 12, including the firing chambers, top plate grooves, and the ink barrier. The other end of the printhead 12 is the same, with numerous intermediate features repeated between the ends. The resistors 30 are arranged in a first row 44 and a second row 46 (not shown) with the resistors being evenly spaced apart in each row. The rows are axially offset by one-half of the resistor spacing to provide an evenly alternating arrangement that provides a higher resolution printed swath. The substrate ink aperture 26 is preferably an elongated oblong; with only a single end shown, however, alternate embodiments of the invention would include circular, elliptical or even rectangular cross-sectioned ink apertures 26.

The substantially planar surface 35, as well as the vertical surface S, both surround the ink aperture 26, whether the aperture is round, oblong or rectangular. As shown in FIGS. 4 (top view) and 5 (cross section), the present invention effectively utilizes grooves 54 (Feature A, shown along A—A) to shunt bubbles on the long shelf region away from the firing chambers. Gas bubbles caught between the two plates are shunted away from the firing chambers toward the ink feed slot drilled through the silicon die. When the bubble reaches the slot, gravity and buoyant forces then guide the bubble up and away from the die (the nozzles fire down toward the paper, i.e., the top plate is actually the bottom-most layer of the system). The addition of the grooves enables the reliable operation of several more nozzles, e.g., up to 275 $\mu$m beyond each end of the slot region, increasing throughput. The percentage of throughput increase depends upon the length of the slot and the nozzle pitch (DPI). For example, a slot length of 4230 $\mu$m would support 50 300 DPI ( approximately 85 $\mu$m spacing) nozzles without these features. With the modifications of 275 $\mu$m beyond each end of the slot region, increasing throughput. The percentage of throughput increase depends upon the length of the slot and the nozzle pitch (DPI). For example, a slot length of 4230 $\mu$m would support 50 300 DPI ( approximately 85 $\mu$m spacing) nozzles without these features. With the modifications of the present invention, an extra 3 nozzles may be added to each end ( 275 $\mu$m/85 $\mu$m), or a throughput improvement of 56/50=12%).

Figure 6:
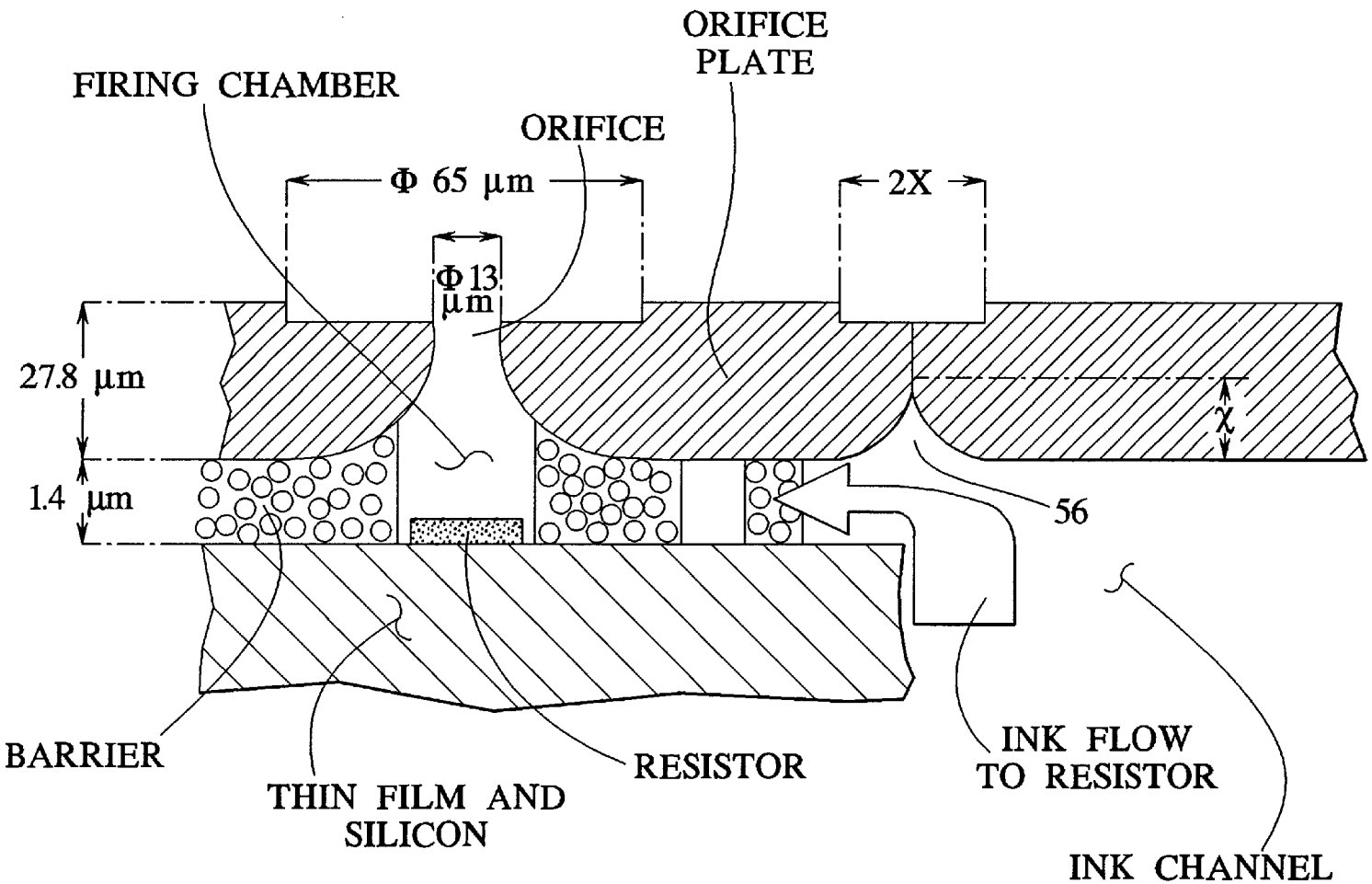
FIG. 6 is a sectional view of the structure shown in FIG. 4 through section lines B—B.

Air bubbles are still a low level problem for those nozzles that do not extend beyond the end of the slow region. The top plate grooves 56 shown along the sides of the ink feed slot in FIG. 4 (top view) and FIG. 6 (cross section) (Feature B, along B—B), by the same principle, improve the reliability of all the nozzles on the die. This feature is a groove or depression in the orifice or top plate running parallel to the line of firing resistors down one side of the ink feed slot, which assists bubble migration from the firing chambers to the ink feed slot.

The grooves may also be used to modulate the fluidic characteristics governing the refilling of the chambers at high firing frequency, altering the fluidic behavior of the nozzles over the frequency range at which they are fired.

The grooves may be constructed such that, as the space that the ink/air bubble occupies progresses from near the firing chamber toward the slot region, the grooves become wider and deeper. In this fashion, a bubble that forms or floats in from another region will tend to grow or migrate away from the more constricted region near the firing chamber. This may occur only when ink in the region is stagnant, as is the case during the periods when the chambers are not being fired.

Figure 5:
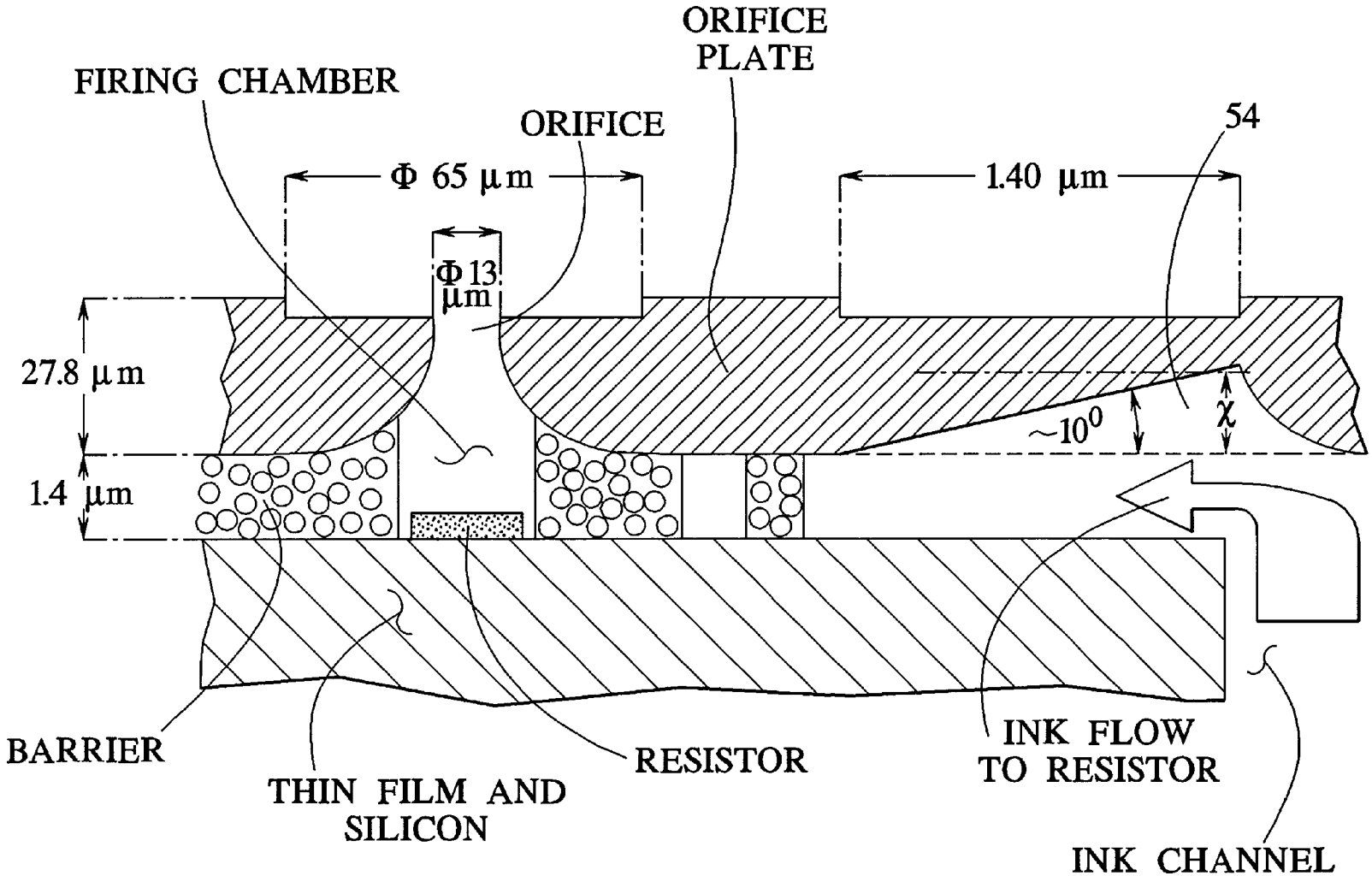
FIG. 5 is a sectional view of the structure shown in FIG. 4 through section lines A—A.

In a preferred embodiment, a slope of at least 10 degrees (see FIG. 5) for the groove 54 of Feature A provides for robust bubble migration. However, it is clear that other slopes may be utilized. For a top plate thickness of approximately 30 $\mu$m, the maximum depression depth that can be achieved while maintaining top plate rigidity is approximately 25 $\mu$m, recognizing that electroplating does not result in a linear surface profile in the direction perpendicular to the long axis of the feature. However, the above-cited approximations are reasonable approximations in the vector between the slot and the end nozzle. The 10 degree angle and 25 $\mu$m rise translate to a slop length of approximately 140 $\mu$m. If the groove is positioned along the diagonal toward the end of the nozzle, when the slope length is added to the maximum shelf length for reasonable nozzle reliability (200 $\mu$m), a maximum diagonal distance between the slot and the end nozzle is approximately 340 $\mu$m, allowing an extra 275 $\mu$m of vertical distance with which to place nozzles, which translates to 3 additional 300 DPI nozzles per slot end. This approximation is based on an assumption that the point of maximum depression is placed at the slot edge. More nozzles may be enabled by positioning the point of maximum depression away from the edge of the slot toward the end nozzles. Also, a thicker top plate would allow for a longer sloping distance and more extra nozzles realized.

Electroplating a nickel top plate provides different depression geometries when different manufacturing processing such as metal etching, laser ablation, stamping and casting are used. Nickel need not be the top plate material, as a variety of other metals and polymers may be similarly patterned and used as top plate material.

In the preferred embodiment, the printhead includes 144 resistors, with a spacing of $1/300^{th}$ inch or 84.67 microns between adjacent resistors in a row, for an effective spacing of half that amount. The overall length of the printhead is 8680 microns, with a slot length of 5690 microns, for a slot end spacing of 1495 microns. The slot end spacing should be no less than about 1345 microns to minimize susceptibility to cracking at the slot ends. In the preferred embodiment, there are eight resistors in the end section at each end. The endmost resistor is centered at a spacing of 930 microns from the substrate edge. The corner of the manifold is at a spacing of 815 microns from the edge, and the vertex extends 970 microns from the edge.

Figure 7:
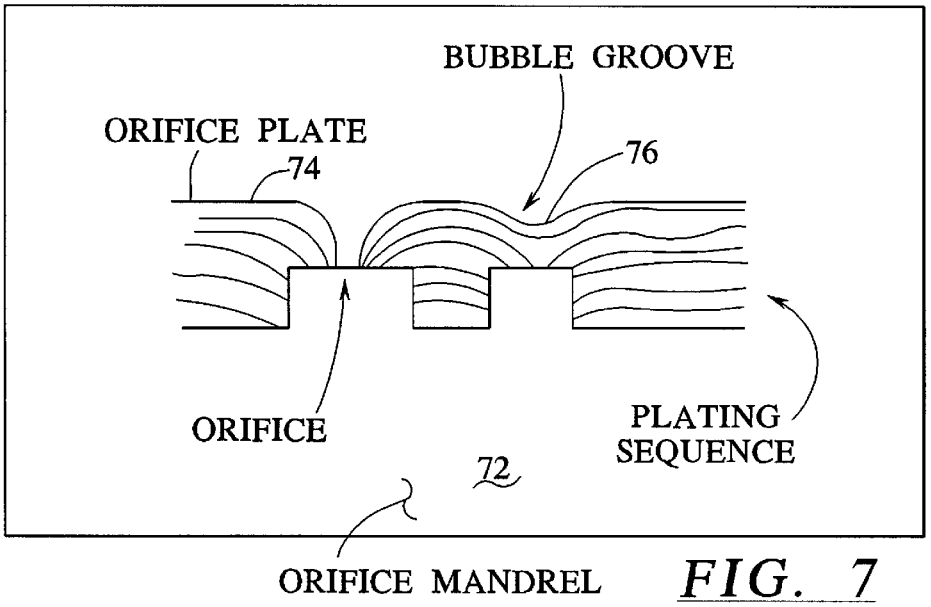
FIG. 7 is a schematic representation of the plating process to form grooves in accordance with the present invention.

Since the top plate is typically constructed from electroformed nickel, the grooved features of the present invention are typically formed on the orifice mandrel 72, as shown in FIG. 7, by over-plating, creating a groove or valley 76 in the orifice plate 74 extending from the slot toward the end firing chamber. This method of over-plating to create top plat features was first utilized in the creation of stress relieving expansion joints, described in U.S. Pat. No. 5,847,725, issued Dec. 8, 1998, by Cleland and Hume. By adjusting the size and shape of mandrel features, the span, shape and slope of the resultant top plate feature may be varied. In the present invention, the depression must eventually return to the original plane of the top plate, but as long as this occurs over the ink feed slot, bubble migration is not impeded.

Figure 8:
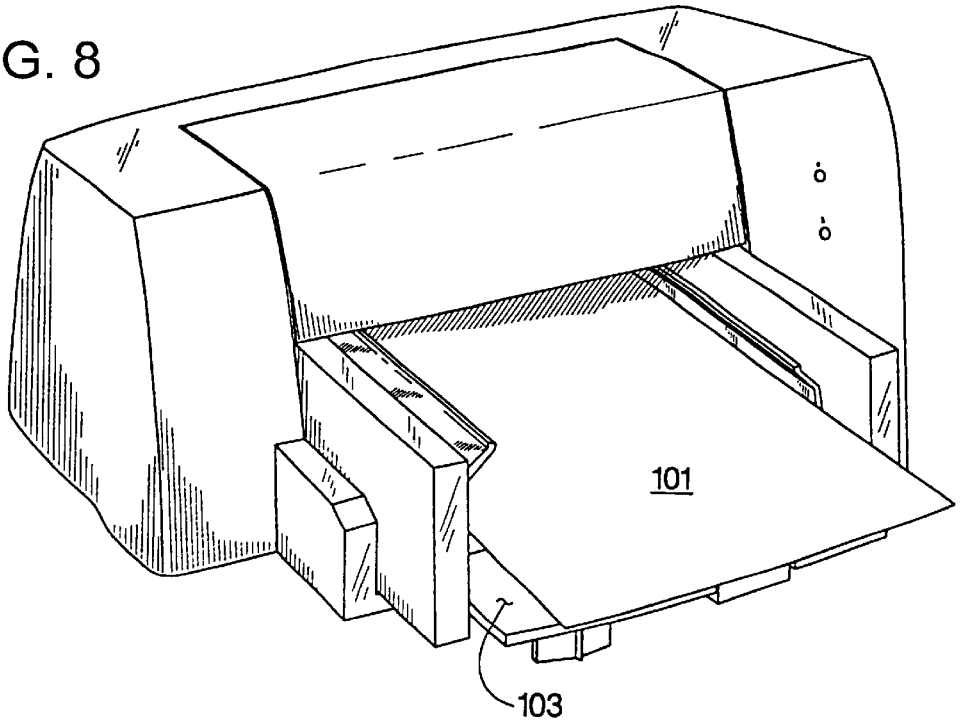
FIG. 8 shows a printer for use with the printhead.
Figure 9:
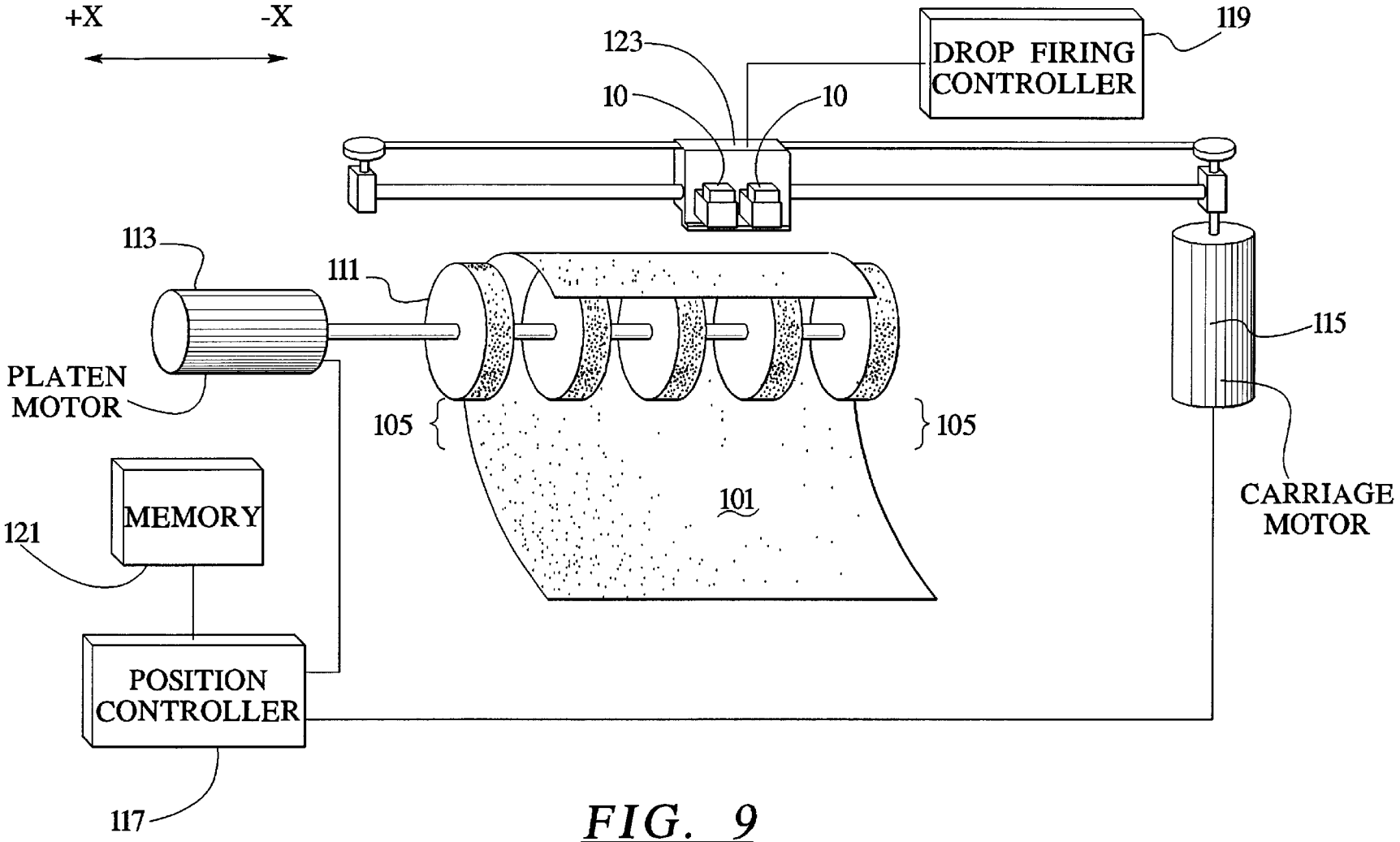
FIG. 9 shows a printer mechanism for use with the printhead.

An inkjet printer which may employ the present invention is illustrated in the isometric drawing of a typical inkjet printer shown in FIG. 8. Paper or other media 101, which may be printed upon, is stored in the input tray 103. Referring to the schematic representation of a printer mechanism of FIG. 9, a single sheet of media is advanced from a medium input 105 into a printer print area defined essentially by the printhead of inkjet pens 10 by a medium advancing mechanism including a roller 111, a platen motor 113, and traction devices (not shown). In a typical printer, one or more inkjet pens 10 are incrementally drawn across the medium 101 on the platen by a carriage motor 115 for a carriage 123 in a direction perpendicular to the direction of entry of the medium. The platen motor 113 and the carriage motor 115 are typically under the control of a media and cartridge position controller 117. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 101 is positioned in a location so that the pens 10 may eject droplets of ink to place dots on the medium as required by the data that is input to a drop firing controller 119 of the printer cartridge. These dots of ink are expelled from the selected orifices in a printhead element of selected pens in a band parallel to the scan direction as the pens 10 are translated across the medium by the carriage motor 115. When the pens 10 reach the end of their travel at an end of a print swath on the medium 101, the medium is typically incrementally advanced by the media and cartridge position controller 117 and the platen motor 113. Once the pens have reached the end of their traverse in the X direction on a bar or other print cartridge support mechanism, they are either returned back along the support mechanism while continuing to print or returned without printing. The medium may be advanced by an incremental amount equivalent to the width of the ink ejecting portion of the printhead or some fraction thereof related to the spacing between the nozzles. Control of the medium, positioning of the pen and selection of the correct ink ejectors of the printhead for creation of an ink image or character is determined by the controller 117. The controller may be implemented in a conventional electronic hardware configuration and provided operating instructions from conventional memory 121. Once printing of the medium is complete, the medium is ejected into an output tray of the printer for user removal. Of course the printer's operation is enhanced by inkjet pens 10 that employ the printhead 12 structures above, including the multi-level surfaces within the ink manifold so as to better control bubble formation and coalescing bubble migration.

The inkjet printer may include an ink container/cartridge for providing ink for an inkjet printer, wherein the ink container/cartridge includes an ink reservoir, an ink channel configured for connection of the ink reservoir to an inkjet printhead, and circuitry for establishing an ink connection to the inkjet printer described above.

While the above is discussed in terms of preferred and alternative embodiments, the invention is not intended to be so limited. For instance, although shown as a single printhead for a single ink color, a printhead may be provided with multiple portions like that shown on a single substrate. Each may have a single ink supply slot connected to its own pen ink chamber, and flanked by rows of nozzles dedicated to that color. In addition, the end wall protrusion may have any protruding shape that reduces the manifold volume along the midline at the end, or which serves to direct ink flow on a more direct path to end nozzles. Rows of firing nozzles need not extend down both sides of an ink feed slot. The present invention is similarly applicable to a single row of resistors down one side of the ink feed slot with a single groove located on the planar plate above the side of the ink feed slot to facilitate bubble management.

What is claimed is:

1. An orifice plate for a thermal ink jet print head comprising:

a planar plate defining a plurality of orifice apertures;

the planar plate defining at least one sloped groove:

wherein the at least one sloped groove extends from an ink feed slot region of the thermal ink jet printhead to a bubble collection area adjacent to an end firing chamber located beyond the ink feed slot region.

2. The orifice plate of claim 1 wherein said at least one sloped groove has a maximum depression at an edge proximate to the ink feed slot region.

3. The orifice plate of claim 1 wherein said at least one sloped groove has a minimum depression away from the edge of the ink feed slot region toward the end firing chamber.

4. The orifice plate of claim 1 further including a sloped groove parallel to and between the ink feed slot region and the firing resistors.

5. The orifice plate of claim 1 further including a plurality of sloped grooves extending away from an edge of the ink feed slot region toward orifice apertures adjacent to the ink feed slot region.

6. The orifice plate of claim 1 wherein the at least one sloped groove is formed by one of: an electroplating process, metal etching, laser ablation, stamping and casting.

7. The orifice plate of claim 1 wherein the at least one sloped groove provides a slope of at least ten degrees from the end firing chamber to the ink feed slot region.

8. An improved thermal inkjet printhead having an orifice plate comprising:

a planar plate defining a plurality of orifice apertures;

the planar plate defining at least one sloped groove:

wherein the at least one groove extends from an ink feed slot region of the thermal inkjet printhead to a bubble collection area adjacent to an end firing chamber located beyond the ink feed slot region.

9. The improved thermal inkjet printhead of claim 8 wherein the at least one sloped groove has a maximum depression at an edge proximate to the ink feed slot region.

10. The improved thermal inkjet printhead of claim 8 wherein the at least one sloped groove has a maximum depression away from the edge of the ink feed slot region toward the end firing chamber.

11. The improved thermal inkjet printhead of claim 8 further including a sloped groove parallel to and between the ink feed slot region and the firing resistors.

12. The improved thermal inkjet printhead of claim 8 further including a plurality of sloped grooves extending away from an edge of the ink feed slot region toward orifice apertures adjacent to the ink feed slot region.

13. The improved thermal inkjet printhead of claim 8 wherein the at least one sloped groove is formed by one of: an electroplating process, metal etching, laser ablation, stamping and casting.

14. The improved thermal inkjet printhead of claim 8 wherein the at least one sloped groove provides a slope of at least ten degrees from the end firing chamber to the ink feed slot region.

15. A method for providing robust bubble migration in a thermal inkjet printhead, comprising the steps of:

providing a depression geometry in a planar plate that defines a plurality of orifice apertures, wherein providing the depression geometry includes providing at least one sloped groove extends from an ink feed slot region of the thermal inkjet printhead to a bubble collection area adjacent to an end firing chamber located beyond the ink feed slot region; and utilizing the planar plate as a top plate over a heated shelf region that includes a plurality of firing chambers for the thermal inkjet printhead.

16. The method of claim 15 wherein the at least one sloped groove includes a maximum depression at an edge proximate to the ink feed slot region.

17. The method of claim 15 wherein the at least one sloped groove includes a minimum depression away from the edge of the ink feed slot region toward the end firing chamber.

18. The method of claim 15 further including a sloped groove parallel to and between the ink feed slot region and the firing resistors.

19. The method of claim 15 further including providing a plurality of sloped grooves extending away from an edge of the ink feed slot region toward orifice apertures adjacent to the ink feed slot region.

20. The method of claim 15 wherein providing the at least one sloped groove is by one of: an electroplating process, metal etching, laser ablation, stamping and casting.

21. The method of claim 15 wherein providing the at least one sloped groove includes providing a slope of at least ten degrees from the end firing chamber to the ink feed slot region for the at least one sloped groove.

22. An inkjet printer comprising:

an inkjet printhead comprising:

a substrate defining an ink aperture through which ink flows from a reservoir, said substrate further having at least first and second major surfaces, said at least first major surface substantially surrounding said ink aperture and said second major surface substantially surrounding said first major surface and further being elevated with respect to said first major surface;

a plurality of ink energizing elements substantially on the second major surface of the substrate:

a barrier layer connected to the second major surface thereby forming wall portions of said barrier layer, said barrier layer peripherally defining an ink manifold, and encompassing the ink aperture;

an orifice plate connected to the barrier layer, spaced apart from the substrate second major surface, enclosing the ink manifold, and defining a plurality of orifice apertures, each associated with a respective ink energizing element, wherein the orifice plate comprises:

a planar plate defining a plurality of orifice apertures;

the planar plate defining at least one sloped groove:

wherein the at least one sloped groove extends from an ink feed slot region of the inkjet printhead to a bubble collection area adjacent to an end firing chamber located beyond the ink feed slot region;

the ink manifold being an elongated chamber having opposed ends and opposed sides defined by end wall portions of the barrier layer;

a printhead carriage; and a printhead position controller.

23. The inkjet of claim 22 wherein the at least one sloped groove has a maximum depression at an edge proximate to the ink feed slot region.

24. The inkjet printer of claim 22 wherein the at least one sloped groove has a minimum depression away from the edge of the ink feed slot region toward the end firing chamber.

25. The inkjet printer of claim 22 further including a sloped groove parallel to and between the ink feed slot region and the firing resistors.

26. The inkjet printer of claim 22 further including a plurality of sloped grooves extending away from an edge of the ink feed slot region toward orifice apertures adjacent to the ink feed slot region.

27. The inkjet printer of claim 22 wherein the at least one sloped groove is formed by one of: an electroplating process, metal etching, laser ablation, stamping and casting.

28. The inkjet printer of claim 22 wherein the at least one sloped groove provides a slope of at least ten degrees from the end firing chamber to the ink feed slot region.

29. An ink container/cartridge for providing ink for an inkjet printer, the ink container/cartridge including:

an ink reservoir;

an ink channel configured for connection of the ink reservoir to an inkjet printhead; and circuitry for establishing an ink connection to the inkjet printer, wherein the inkjet printhead comprises:

a substrate defining an ink aperture through which ink flows from a reservoir, said substrate further having at least first and second major surfaces, said at least first major surface substantially surrounding said ink aperture and said second major surface substantially surrounding said first major surface and further being elevated with respect to said first major surface;

the plurality of ink energizing elements substantially on the second major surface of the substrate;

a barrier layer connected to the second major surface thereby forming wall portions of said barrier layer, said barrier layer peripherally defining an ink manifold, and encompassing an ink aperture;

an orifice plate connected to the barrier layer, spaced apart from the substrate second major surface, enclosing the ink manifold, and defining a plurality of orifice apertures, each associated with a respective ink energizing element, wherein the orifice plate comprises:

a planar plate defining a plurality of orifice apertures;

the planar plate defining at least one sloped groove:

wherein the at least one groove extends from an ink feed slot region of the inkjet printhead to a bubble collection area adjacent to an end firing chamber located beyond the ink feed slot region;

the ink manifold being an elongated chamber having opposed ends and opposed sides defined by end wall portions of the barrier layer;

a printhead carriage; and a printhead position controller.

* * * * *